US006839038B2

(12) United States Patent
Weinstein

(10) Patent No.: US 6,839,038 B2
(45) Date of Patent: Jan. 4, 2005

(54) DUAL-BAND DIRECTIONAL/ OMNIDIRECTIONAL ANTENNA

(75) Inventor: Michael E. Weinstein, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/171,755

(22) Filed: Jun. 17, 2002

(65) Prior Publication Data

US 2003/0231138 A1 Dec. 18, 2003

(51) Int. Cl.[7] ..... H01Q 9/16

(52) U.S. Cl. ..... 343/795; 343/792.5; 343/793; 343/803; 343/815

(58) Field of Search ..... 343/803, 4, 790, 343/792, 792.5, 795, 815–819, 793

(56) References Cited

U.S. PATENT DOCUMENTS

| | | | | |
|---|---|---|---|---|
| 3,007,167 A | | 10/1961 | Winegard | |
| 3,707,681 A | | 12/1972 | Grant | |
| 4,119,970 A | | 10/1978 | Bogner et al. | |
| 4,149,170 A | * | 4/1979 | Campbell et al. | 343/885 |
| 4,218,686 A | * | 8/1980 | Blonder | 343/819 |
| 4,410,893 A | | 10/1983 | Griffee | |
| 4,509,056 A | * | 4/1985 | Ploussios | 343/791 |
| 4,555,708 A | | 11/1985 | Waineo et al. | |
| 4,814,777 A | | 3/1989 | Monser | |
| 4,821,040 A | | 4/1989 | Johnson et al. | |
| 4,959,657 A | | 9/1990 | Mochizuki | |
| 4,963,879 A | | 10/1990 | Lin | |
| 5,061,944 A | * | 10/1991 | Powers et al. | 343/795 |
| 5,155,495 A | | 10/1992 | Hately et al. | |
| 5,508,710 A | | 4/1996 | Wang et al. | |
| 5,652,598 A | * | 7/1997 | Campbell et al. | 343/791 |
| 5,710,569 A | * | 1/1998 | Oh et al. | 343/817 |
| 5,969,687 A | | 10/1999 | Podger | |
| 5,995,060 A | | 11/1999 | Podger | |
| 6,028,558 A | | 2/2000 | Van Voorhies | |
| 6,057,804 A | * | 5/2000 | Kaegebein | 343/792 |
| 6,307,524 B1 | | 10/2001 | Britain | |
| 6,483,476 B2 | * | 11/2002 | Cox | 343/815 |
| 2002/0113743 A1 | * | 8/2002 | Judd et al. | 343/757 |

FOREIGN PATENT DOCUMENTS

| | | |
|---|---|---|
| DE | 88 03 621 U1 | 6/1988 |
| GB | 813 614 | 5/1959 |

OTHER PUBLICATIONS

J.D. Kraus, *Antennas*, 2nd Edition, McGraw–Hill, New York, 1988, pp. 481–483.

Tefiku F., et al., "Design Of Broad–Band And Dual–Band Antennas Comprised Of Series–Fed–Printed–Strip Dipole Pairs", IEEE Transactions On Antennas And Propagation, IEEE Inc., NY, USA, vol. 48, No. 6, Jun. 2000 pp. 895–900, XP000959047.

* cited by examiner

*Primary Examiner*—Tho Phan
(74) *Attorney, Agent, or Firm*—Burns, Doane, Swecker & Mathis, L.L.P.

(57) ABSTRACT

An antenna having a dual-band driven element and a second antenna element simultaneously produces a directional radiation pattern at an upper frequency and an omnidirectional radiation pattern at a lower frequency. The dual-band driven element is formed as a dipole or monopole with at least one choke connected to the end of the dipole or monopole. In an exemplary embodiment, the dual-band driven element includes a central dipole or monopole that has chokes formed as u-shaped extensions located at the ends of the central antenna dipole or monopole. An antenna array includes the dual-band driven element and a second driven antenna element with a reflector and/or a director in a Yagi-Uda configuration. An antenna array includes the dual-band driven element with a reflector or with a reflector and a director in a Yagi-Uda configuration.

33 Claims, 7 Drawing Sheets

DUAL-BAND DIRECTIONAL/ OMNIDIRECTIONAL ANTENNA

BACKGROUND OF THE INVENTION

1. Field of the Invention

The present invention relates to electromagnetic radiating antennas. More particularly, the present invention relates to an antenna that can provide an omnidirectional and a directional radiation pattern over at least two different frequency bands of operation.

2. Background Information

There are various dual-band and dual polarization omnidirectional antennas found in the prior art. In U.S. Pat. No. 4,814,777, "Dual-Polarization Omni-Directional Antenna System", a dual-polarization, omnidirectional is disclosed. In U.S. Pat. No. 4,410,893, "Dual Band Collinear Dipole", a dual-band collinear dipole antenna that provides omnidirectional patterns in two frequency bands is disclosed. The disclosure of these patents is hereby incorporated by reference in their entirety.

A Yagi-Uda dipole antenna has at least three dipole elements: a dipole reflector, a driven dipole element (feed element), and a dipole director. A Yagi-Uda dipole antenna operates at one frequency band to produce directed radiation. Yagi-Uda antennas are discussed in H. Yagi, "Beam Transmission of Ultra Short Waves," Proc. IRE, vol. 26, June 1928, pp. 715–741; T. Milligan, Modern Antenna Design, McGraw-Hill, New York, 1985, pp. 332–345; and J. D. Kraus, Antennas, $2^{nd}$ Edition, McGraw-Hill, New York, 1988, pp. 481–483, the disclosures of which are incorporated herein in their entirety.

It would be useful for an antenna to be able to simultaneously produce a directional radiation pattern over one frequency band and an omnidirectional radiation pattern over another frequency band.

SUMMARY

An exemplary embodiment of the invention is an antenna system with a dual-band driven antenna element for operation at an upper frequency and a lower frequency and a second antenna element, wherein, in response to an applied electrical current having an upper and a lower frequency, the antenna system radiates in a directional pattern at the upper frequency and in an omnidirectional pattern at the lower frequency. The dual-band driven element can be a dipole or monopole antenna. In an exemplary embodiment, the dual-band driven antenna element can include a center dipole that radiates at the upper frequency in response to an applied current at an upper frequency and at least one choke electrically connected to the center dipole, wherein the center dipole and the choke radiate at a lower frequency in response to an applied current at a lower frequency. The choke can shorten an electrical length of the dual-band driven antenna element at an upper frequency, allowing the simultaneous operation of the dual-band driven antenna element at a lower frequency and at an upper frequency.

In an exemplary embodiment, dipole dual-band driven element includes a center dipole with a first choke electrically connected to a first end of the center dipole and a second choke electrically connected to a second end of the center dipole. The first and second chokes shorten an electrical length of the dipole dual-band antenna element at an upper frequency, wherein the center dipole radiates at the upper frequency in response to an applied current at the upper frequency, and wherein the center dipole and the chokes radiate at a lower frequency in response to an applied current at the lower frequency.

In another exemplary embodiment, the dipole dual-band driven element includes two chokes electrically connected to a first end of the center dipole and two chokes electrically connected to a second end of the center dipole. The two chokes electrically connected to the first end of the center dipole and the two chokes electrically connected to the second end of the center dipole shorten an electrical length of the dual-band antenna element at an upper frequency. The center dipole radiates at the upper frequency in response to an applied current at the upper frequency, and wherein the center dipole and the chokes radiate at a lower frequency in response to an applied current at the lower frequency.

The dual-band driven antenna element can also include a frequency selective impedance matching circuit connected in series between the center dipole and the choke, the frequency selective impedance matching circuit being adapted to match the impedance of a transmission line. The impedance matching circuit can be a resistor or a reactance element.

In an exemplary embodiment, the second antenna element can be a reflector that reflects radiation at the upper frequency. The reflector can be printed wiring having a length of about one half of a wavelength of radiation at the upper frequency. The reflector can have a width that is greater than a width of the dual-band driven antenna element.

In another exemplary embodiment, the second antenna element is at least one director, configured to direct radiation at the upper frequency. The at least one director can also be printed wiring on the dielectric substrate.

In another exemplary embodiment, the second antenna element is a second driven element electrically coupled to the dual-band driven element, and is operational at the upper frequency. The dual-band driven element and the second driven element can be electrically coupled by a transmission line. The transmission line can be a balanced transmission line adapted to provide electrical power to the dual-band driven antenna element and the second driven antenna element.

In an exemplary embodiment, the transmission line can comprise two parts, a first part printed on a first side of a dielectric sheet, and a second part printed on a second side of the dielectric sheet. The first transmission line part can include a first and a second electrically conductive trace printed on the first side of the dielectric sheet, the first and second traces being substantially parallel and being connected at their ends and separated in a region between their ends by a material with a dielectric constant of about one. The second transmission line part can include a third and a fourth electrically conductive trace printed on the second side of the dielectric sheet, the third and fourth traces being parallel and being connected at their ends and being separated in a region between their ends by a material with a dielectric constant of about one. An opening can be formed through the dielectric sheet between at least two of the metal traces. Openings can be formed through the dielectric sheet on either side of the transmission line traces. For example, a second opening can be formed through the dielectric sheet in an area outside the transmission line; and a third opening formed through the dielectric sheet in a second area outside the transmission line opposite the first area.

In another exemplary embodiment, the dual-band driven element and the second driven antenna elements are dipoles. The antenna system can also include a balun configured to receive unbalanced electrical power and to provide balanced electrical power to the dipole dual-band driven element and the dipole second driven antenna element. The balun can be a compensated balun electrically coupled to the dual-band driven element and to the transmission line. A longitudinal axis of the balun can be arranged substantially perpendicular to a principal axis of the dipole dual-band driven element and to the principal axis of the dipole second driven element, and substantially parallel to the transmission line. In another exemplary embodiment, the antenna system can include a reflector configured to reflect radiation at the upper frequency, and can form a Yagi-Uda antenna array. Alternatively, the antenna system can also include at least one director configured to direct radiation at the upper frequency, so the dual-band driven antenna element, the second driven element, and the at least one director element are arranged to form a Yagi-Uda antenna array. The antenna system can also include both a reflector and a director that operate at the upper frequency, arranged to form a Yagi-Uda antenna array. In an exemplary embodiment, this antenna system can include a dipole dual-band driven element and second driven antenna element.

In an exemplary embodiment, the dipole dual-band driven element includes a center dipole, two chokes electrically connected to a first end of the center dipole, and two chokes electrically connected to a second end of the center dipole. The chokes shorten an electrical length of the dual-band antenna element at the upper frequency so the center dipole radiates at the upper frequency in response to an applied current at the upper frequency, and both the center dipole and the chokes radiate at the lower frequency in response to an applied current at the lower frequency. Each choke can include a u-shaped extension with an end of the extension connected to an end of the center dipole, the u-shaped extension having two legs which form a quarter-wavelength transmission line at the upper frequency, and a segment of the u-shaped extension forms a short circuit to current at the upper frequency. In an exemplary embodiment, a conductive extension can be electrically coupled to the short circuit segment of at least one u-shaped extension, the conductive extension adapted to maintain radiation efficiency at the upper frequency and to improve radiation efficiency and input impedance bandwidth at the lower frequency. In an exemplary embodiment, the dual-band driven antenna element has an electrical length that is short relative to one half of a wavelength at the lower frequency, and the dual-band driven element includes devices electrically connected to the u-shaped extension at the short circuit segment of the u-shaped extension. The impedance devices enable the center dipole and the u-shaped extensions to radiate with improved radiation efficiency at the lower frequency in response to an applied current at the lower frequency.

An exemplary embodiment of the present invention is directed to a dual mode antenna arranged in a Yagi-Uda configuration, which can simultaneously support both an omnidirectional radiation pattern and a directional radiation pattern over at least two different frequency bands. The antenna includes at least one driven element. The antenna can include a reflector for reflecting radiation at one of the frequency bands, and can also include directors for directing radiation.

In an exemplary embodiment, the antenna includes a dual-band driven dipole element that includes a choke for preventing a portion of the dipole from operating at the higher frequency band. The dual-band driven element can be electrically short at the lower frequency band and include frequency selective impedance matching devices to achieve the desired balance between antenna radiation efficiency and input impedance bandwidth. The dual-band driven element may also include extensions and electrical devices that improve efficiency and bandwidth at the lower frequency band.

In an exemplary embodiment, the antenna includes a second driven element which cooperates with the dual-band driven element to produce a directional radiation pattern at one of the frequency bands, but does not interfere with the omnidirectional radiation pattern at the other frequency band.

BRIEF DESCRIPTION OF THE DRAWINGS

Other objects and advantages of the present invention will become apparent to those skilled in the art upon reading the following detailed description of the preferred embodiments, in conjunction with the accompanying drawings, wherein like reference numerals have been used to designate like elements, and wherein:

FIG. 3A indicates the section line 1—1 for the FIG. 3C view.

DETAILED DESCRIPTION OF THE PREFERRED EMBODIMENTS

One embodiment of the present invention includes a Yagi-Uda antenna array that uses a novel dual-band driven element to produce an omnidirectional radiation pattern at a frequency other than the Yagi-Uda antenna's normal operating frequency band (such as at a lower frequency), while simultaneously maintaining the normal directional radiation pattern of the Yagi-Uda antenna at its normal operating frequency.

The present invention provides several advantages over other antenna systems. Simultaneous directional and omnidirectional radiation patterns can be achieved at different frequencies. Further, the present invention provides greater antenna frequency bandwidth for antenna gain, radiation patterns, and input impedance than an ordinary Yagi-Uda antenna array. The present invention can use an impedance matching device or circuit that only affects the lower frequency band through the isolation achieved by the special dual-band element invention. Additionally, full radiation efficiency is possible in both frequency bands.

Figure 1:
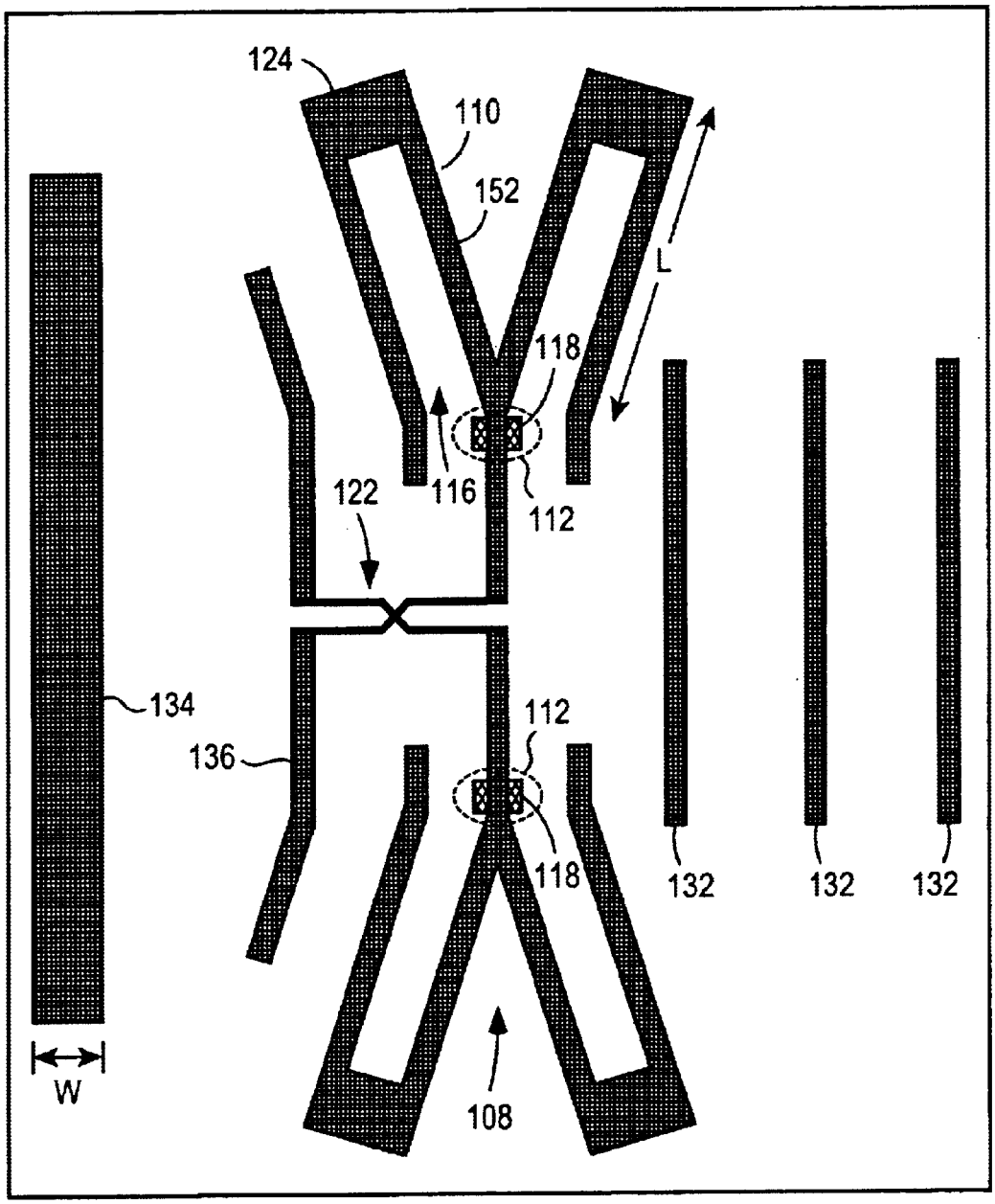
FIG. 1 is a sketch of an exemplary dual-band directional/omnidirectional antenna.

FIG. 1 illustrates an antenna system 100 in accordance with an exemplary embodiment of the invention. The antenna system 100 includes a dual-band driven antenna element 108 for operation at an upper frequency and a lower frequency. The antenna system 100 includes a second antenna element, wherein in response to an applied electrical current at an upper and a lower frequency, the antenna system radiates in a directional pattern at the upper frequency and in an omnidirectional pattern at the lower frequency. The second antenna element can be any element configured to permit the antenna system 100 to radiate in an omnidirectional pattern at a first frequency and in a directional pattern at a second frequency in response to an applied electrical current. In the exemplary embodiment of FIG. 1, the second antenna element can include directors 132 that acts to direct radiation at an upper frequency in the forward direction (shown as the x direction in FIG. 1). Alternately, the second antenna element can be a reflector 134, which reflects upper frequency radiation from the dual-band driven element 108 in a forward direction. The second antenna element also can be a second driven antenna element 136, which is operational at an upper frequency. In the exemplary embodiment of FIG. 1, the antenna system 100 includes a reflector 134, directors 132, and a second driven antenna element 136.

Directional and omnidirectional patterns refer to the pattern of radiation produced or received by an antenna in a plane. For example, a dipole antenna element has a radiation pattern that is omnidirectional in a plane normal to the axis of the dipole.

An exemplary embodiment of a dual-band driven element 108 that can be used in a dual-band omnidirectional/directional antenna is shown in FIG. 1. The dual-band driven element 108 operates at both a lower and an upper frequency. In an exemplary embodiment, the lower frequency is within a lower frequency band that is a UHF frequency band, and the upper frequency is within an upper frequency band that is an L-band frequency band. The driven element 108 can be fed at the balanced terminals 120 by a balanced mode radio frequency (RF) signal source. A balun may also be employed to provide feeding by an unbalanced mode, e.g. coaxial, RF signal source. In the embodiment shown in FIG. 1, the dual-band driven element 108 is a dipole antenna element, although a monopole or other antenna embodiment can also be used.

To operate (that is, to radiate or receive radiation) at both the upper and lower frequencies, the dual-band driven element 108 has at least one choke 110, which chokes off radiating upper band currents, preventing upper band currents present in the choke 110 from producing far field radiation. An exemplary choke is shown in FIG. 1 as a u-shaped extension end 110 located and electrically coupled to an end of the central dipole 114.

The dual-band driven element 108 can have more than one choke. For example, a choke can be located at each end of the central dipole 114 of the dual-band driven element 108, to provide a reasonably long length for lower frequency operation. In the exemplary embodiment shown in FIG. 1, a central dipole 114 has four u-shaped extension ends 110 electrically connected to the ends of the central dipole 114. The use of four u-shaped extension ends, two at each end of the central dipole 114, provides more choking and a longer effective length at the lower frequency.

Although the u-shaped extensions 110 of FIG. 1 are coplanar with the central dipole 114 of the driven element 108, other alternative chokes that can be used can extend out of this plane. An alternative choke can be formed as a cone or other shape, with an electrical connection to the central dipole region 114. Such a cone-shaped choke can be visualized by rotating the u-shaped extensions 110 about the longitudinal axis of the central dipole 114.

In the exemplary embodiment shown in FIG. 1, the dual-band central dipole 114 is a dipole with a length that allows it to radiate at an upper frequency. The dual-band central dipole 114, together with the u-shaped extension ends 110, also radiates at the lower frequency.

Each u-shaped extension end 110 acts as a one-quarter-wavelength transmission line at the upper frequency. The distal end 124 of the u-shaped extension 110 acts as a short circuit to this transmission line at the upper frequency. The length L of the extension end 110 is approximately one-quarter of the wavelength of the operating frequency at the upper frequency. The two legs 152, 154 of the u-shaped extension 110 should be sufficiently far apart to provide a suitably high characteristic impedance.

Each u-shaped extension end 110 presents a high impedance and thus minimizes upper frequency currents at its proximal, open circuited end 116. Thus, the u-shaped extension end 110 acts as a high frequency choke to shorten the electrical length of the driven element 108 at the upper operating frequency. This choke, however, has less effect on the lower frequency currents, since the u-shaped extension is shorter relative to the lower wavelength. Therefore, both the u-shaped extensions 110 and the central dipole portion 114 radiate at the lower frequency band. The electrically shortened length at the upper frequency thus permits the simultaneous operation of the dual-band driven element 108 at both a lower frequency and an upper frequency.

Of course, the dual-band driven element 108, and other antenna elements discussed herein, can also receive incident radiation and produce an electrical current that corresponds to the received radiation. An antenna that uses these elements may either transmit or receive radiation.

To reduce the overall size of the antenna, the driven element 108 can be constructed with an overall length that is electrically short to the lower frequency. Ordinarily, an electrically short dipole radiates inefficiently and reflects a significant percentage of power applied to its terminals back down the connected RF transmission line. To enable the driven element to radiate efficiently at the shortened length, an impedance matching circuit 118 that includes impedance matching devices, e.g., resistors or reactance elements such as capacitors and inductors, may be added in series with the radiating element to add resistance and/or reactance. In an exemplary embodiment, the impedance matching devices 118 are added in a region 112 between the central dipole 114 and the chokes 110, just inside the open end 116 of the chokes 110. Because the region 112 is located where upper frequency currents are minimized due to the presence of the choke, impedance matching devices 118 have a significant effect on the lower band operation, while having a negligible effect on upper band operation, thus allowing frequency selective impedance matching. As will be clear to those skilled in the art, the resistance and/or reactance of these devices can be tailored to achieve the desired balance between antenna radiation efficiency and input impedance bandwidth.

The reflected power can be reduced by inserting a resistance in series with the dipole's radiation resistance such that the total series resistance more closely matches the characteristic impedance of the transmission line that provides electrical power to the antenna element. This technique improves the input impedance, by reducing the reflected power, but does not improve the radiation efficiency because the non-radiated power is dissipated by the added series resistance. Alternately, the reflected power may be reduced by employing reactance elements or their distributed equivalents to improve the impedance match. A purely reactive impedance matching technique will allow the dipole to realize full radiation efficiency, but will reduce its input impedance bandwidth due to the increased circuit Q caused by the additional reactance. A mix of resistive and reactive devices will achieve any desired trade-off of radiation efficiency and input impedance bandwidth.

Figure 2:
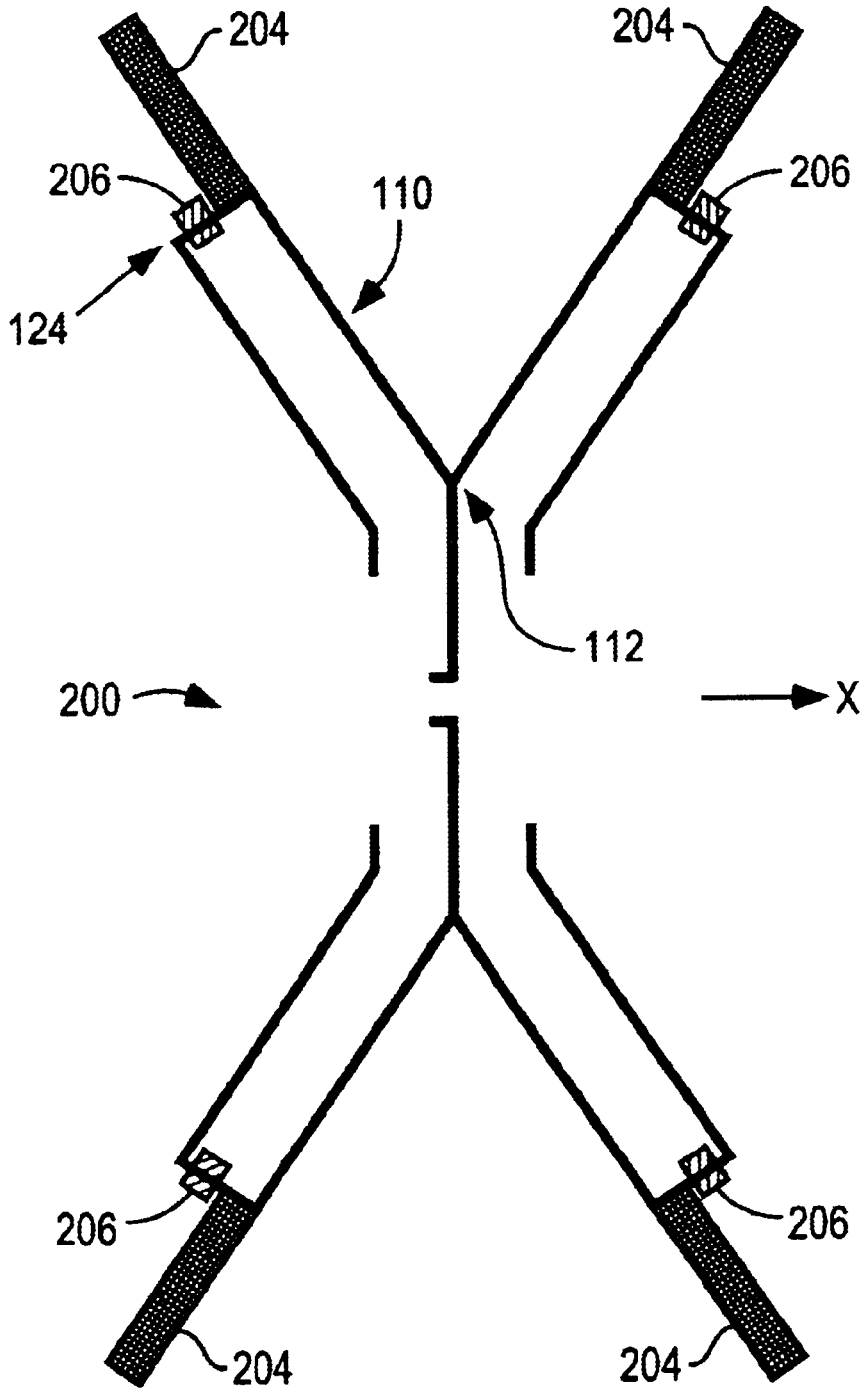
FIG. 2 is a sketch of an exemplary embodiment of a dual-band driven element for use in a dual-band directional/omnidirectional antenna.

FIG. 2 illustrates another exemplary embodiment of a dual-band driven element 200, which is configured as a dipole that is electrically short to the lower frequency. The dual-band driven element 200 includes at least one high frequency choke 110. In an exemplary embodiment, each choke 110 is configured as a u-shaped extension that acts as a quarter-wavelength transmission line (at the upper frequency) that is short-circuited at the distal end 124.

An extension 204 can be added at the short-circuited segment 124 of the u-shaped extension end 110. The extension 204 can be a conductive wire or other conductive metal, or may be a metal trace printed on a dielectric substrate. Addition of the extension 204 to the dual-band driven element 200 increases the overall length of the dual-band driven element, without changing the length or location of the high frequency choke. By increasing the overall length of the dual-band driven element and maintaining the length and location of the chokes, the dipole dual-band driven element 200 becomes electrically longer but still remains shorter than a resonant half-wavelength at the lower frequency. The additional length provided by the extensions 204 results in higher efficiency and bandwidth at the lower frequency.

In the exemplary embodiment shown in FIG. 2, impedance devices 206 are inserted into the short circuit segment 124 of the u-shaped extensions 110. The impedance device 206 can be a parallel inductance-capacitance (LC) circuit that resonates near the lower frequency. This has the desirable quality of reducing the effectiveness of the choke at the lower frequency, by presenting a high reactance and effectively disconnecting the u-shaped extensions. The parallel LC circuit also maintains the effectiveness of the choke at the upper frequency, by presenting a low reactance and effectively maintaining the connection.

Although FIGS. 1 and 2 illustrate a dipole-based antenna element, those skilled in the art will realize that a monopole-based implementation of the present invention can be used without deviating from the spirit and scope of the present invention.

Various exemplary antennas may be constructed using the dual-band driven element. An antenna system may be formed with a dual-band driven antenna element and a second antenna element that cooperate to simultaneously produce an omnidirectional radiation pattern at a lower frequency, and a directional radiation pattern at an upper frequency. The second antenna element may be a second driven antenna element, a reflector that reflects radiation at the upper frequency, or a director that directs radiation at the upper frequency. Various combinations of these elements can form exemplary antenna systems in accordance with the invention.

The exemplary antenna array of FIG. 1 is configured as a Yagi-Uda antenna array, although other types of antenna arrays are also envisioned within the scope of the invention. Generally speaking, an antenna array having one actively driven element (the element connected to the transmission line), often called the feed element, and two or more parasitic elements, e.g., a reflector and one or more directors, is known as a Yagi-Uda antenna array. An antenna array is a multi-element antenna. A Yagi-Uda dipole antenna is an end-fire antenna array employing dipole antenna elements, which are usually all in the same plane. Generally, the driven element parasitically excites the others to produce an endfire beam.

In the embodiment of FIG. 1, the reflector and directors are configured to operate at the upper frequency. For example, the lengths of the directors are approximately equal to one-half of the wavelength of the upper frequency. Other parameters of a Yagi-Uda antenna array are well known to those skilled in the art. The antenna elements can be spaced at a distance from each other equal to approximately 0.1 times the wavelength of the upper frequency. As in conventional Yagi-Uda antenna arrays, various numbers of directors may be used to control the gain and radiation characteristics of the antenna. In the exemplary embodiment of FIG. 1, the width W of the reflector, or the diameter of the reflector if the reflector is wire, can be greater than the width of the driven element 108 and the directors 132, for improved antenna performance.

As discussed above, due to the operation of the chokes 110, the dual-band driven element 108 resonates at both an upper and a lower frequency. Cooperation between the driven element 108, the reflector 134, and the directors 132 allows the reflector and directors to direct the upper frequency radiation in a forward direction (shown as X in FIG. 1). The driven element 108 also radiates at a lower frequency band, and produces an omnidirectional radiation pattern at the lower frequency band which is largely unaffected by the parasitic elements 134 and 132. Thus, the driven element 108 enables the antenna to exhibit omnidirectional operation at a lower frequency and directional operation at an upper frequency.

In the exemplary FIG. 1 embodiment, the second driven element 136 of the antenna array is located between the reflector 134 and the dual-band driven element 108. In the exemplary embodiment shown in FIG. 1, the second driven element 136 is a dipole element that operates at the upper frequency. The second driven element 136 acts cooperatively with the dual-band driven element 108 and the parasitic elements 132 and 134 to produce more gain and to increase the bandwidth of the antenna in an upper frequency band that includes the upper frequency. Operation of the second driven element 136 at the upper frequency does not interfere with the operation of the dual-band driven element 108 at the lower frequency.

The use of two or more driven elements will increase the frequency bandwidth of both the input impedance and the radiation patterns, increase antenna gain, and improve radiation pattern performance such as front-to-back ratio. The use of two driven elements particularly improves the performance of Yagi-Uda antennas having only a few parasitic elements.

The ends of the second driven element 136 can be formed so they bend away from the dual-mode antenna element 108, to reduce any interference between the second driven element 136 and the u-shaped extensions 110 of the dual mode driven antenna element 108.

The antenna system can also include a transmission line 122 electrically connected to the dual band driven element 108 and the second driven element 136. When the driven elements are dipoles, as in the exemplary embodiment of FIG. 1, a balanced transmission line can provide electrical current to the dipoles. The balanced transmission line for a dipole antenna can have a characteristic impedance of approximately 100 ohms.

Figure 3A:
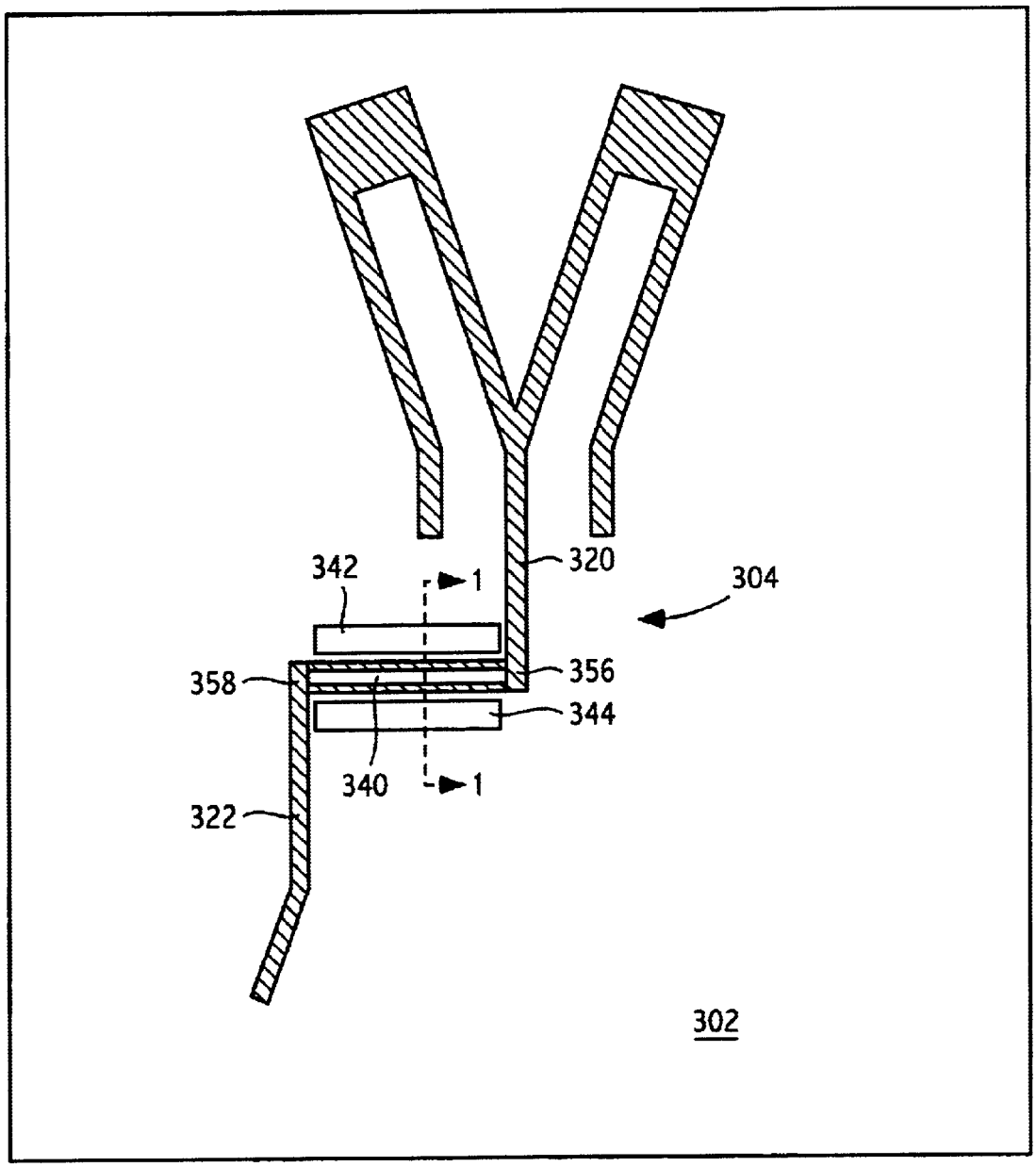
FIGS. 3A and 3B are plan views of a printed wiring embodiment of an antenna including a transmission line, a dual-band driven antenna element, and a second driven element mounted on a substrate.
Figure 3B:
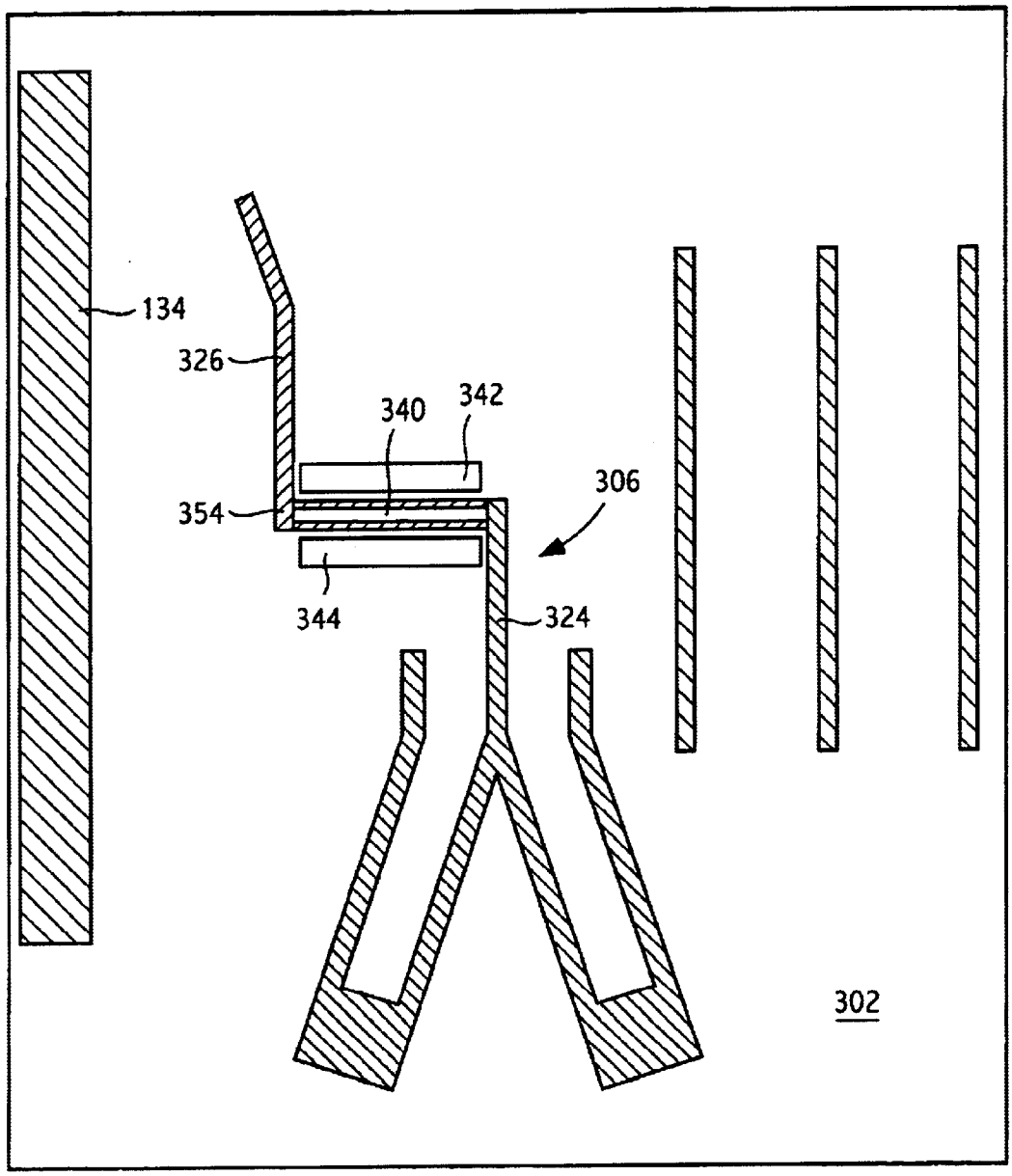
Figure 3C:
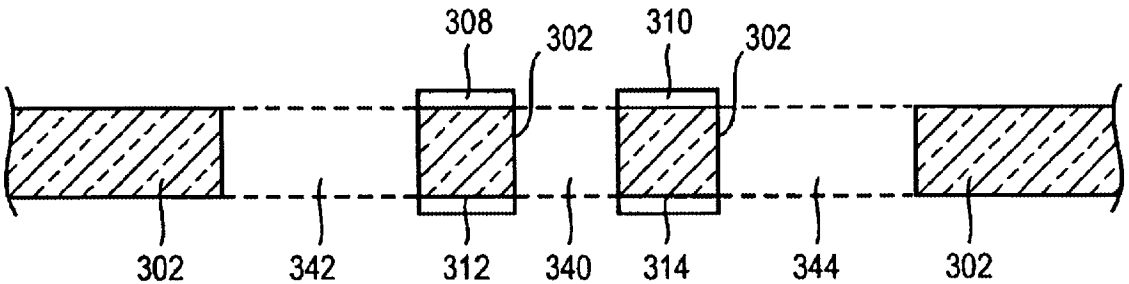
FIG. 3C is a cross sectional view of the FIGS. 3A and 3B embodiment.

In an exemplary embodiment, the transmission line 122 is an air-filled, crisscross transmission line that provides balanced mode excitation with the proper phase relationship between the driven elements. FIGS. 3A, 3B, and 3C (not to scale) illustrate an exemplary 100 ohm, reduced dielectric, balanced transmission line 122 for use with an exemplary printed wiring embodiment of a dual-band directional/omnidirectional antenna. In the exemplary embodiment of FIGS. 3A–3C, the transmission line 122 includes printed wiring on two sides of a dielectric sheet. When the antenna elements are constructed from metal traces printed on a dielectric substrate, it is desirable to also form the transmission line that connects the two driven elements as metal traces printed on the dielectric sheet, although the transmission line can be actual wires, or any other suitable material for providing electrical current to the driven elements.

In the exemplary embodiment shown in FIGS. 3A, 3B, and 3C, electrical power is provided to the dual-band driven element 108 and to the transmission line 122 at terminals 330, 332. The dielectric sheet 302 separating the printed wiring that forms the various antenna elements and the transmission line 122 can be any suitable material for separating the printed wiring. The dielectric sheet preferably has a dielectric constant greater than one. In an exemplary embodiment, the dielectric sheet is 0.060 inches thick and has a dielectric constant of 3.0. In an exemplary embodiment, the metallization that forms the transmission line, the reflector 134, and the driven elements 108, 136 is one-ounce electro deposited copper, although other suitable types and thicknesses of electrically conductive materials can also be used. Directors (not shown) can also be formed forward of the dual-band driven antenna element.

On a first surface of the dielectric sheet 302, a first half 320 of the dual-band driven antenna element 108, a first half 322 of the second driven antenna element 136, and a first half of the transmission line 122 are formed. On the second surface of the dielectric sheet 302, a second half 324 of the dual-band antenna element 108, a second half 326 of the second dipole antenna element 136, and a second half of the transmission line 122 are formed. The first half of the transmission line 122 includes two parallel metal traces 308 and 310 connected at ends 356, 358. The second half of the transmission line, printed on the opposite side of the dielectric sheet 302, includes two parallel metal traces 312 and 314 connected at ends 352, 354.

When the transmission line is printed on a dielectric sheet, the trace width, sheet thickness, and dielectric constant of the dielectric material control the characteristic impedance, while the dielectric constant primarily controls the phase velocity. Removing dielectric material from either side of the transmission line 122 to form openings 342, 344 through the dielectric material increases phase velocity to a value that is closer to an air-filled transmission line. The openings can be formed by removing the dielectric material after the metal traces have been printed. However, removing dielectric material from either side of the transmission line may not raise the phase velocity enough. Removing additional dielectric material from within the transmission line by, for example, drilling a series of holes or milling a slot along the centerline of the transmission line, and adjusting the trace geometry will further increase the phase velocity and maintain the characteristic impedance. In the exemplary embodiment of FIGS. 3A–3C, the dielectric sheet 302 has a slot-shaped opening 340 formed through the dielectric sheet 302 between the parallel traces. In an exemplary embodiment, each opening 342, 344 on either side of the transmission line 122 is about twice as wide as the slot 340 through the dielectric material between the transmission line traces. Transmission line portions 308 and 312 are on one side of the slot 340, and transmission line portions 310, 314 are on the other side of the slot 340. To maintain the desired characteristic impedance, the trace width of the transmission line portions 308, 310, 312, 314 can be increased slightly. These techniques maximize the phase velocity by maximizing the amount of fringing electric field in the surrounding and internal air, while maintaining the desired characteristic impedance and allowing fabrication by standard printed wiring methods. Those skilled in the art will realize that these techniques can also applied to an unbalanced transmission line that would be used in a monopole-based implementation of the present invention without deviating from the spirit and scope of the present invention.

An antenna with dipole-based driven elements operates best with a balanced electrical source. To drive a dipole element with an unbalanced source (e.g. a coaxial cable or a microstrip line), a balun, matching network, or other device that converts an unbalanced signal such as that supported by a coaxial cable, to a balanced signal can be used. As used herein, the term balun includes any device that converts an unbalanced electrical signal into a balanced signal. A compensated balun is useful because it has adequate bandwidth to operate at both a lower and an upper frequency, and can, with a compensating transmission line, provide impedance matching for an antenna over a range of frequencies.

Figure 4:
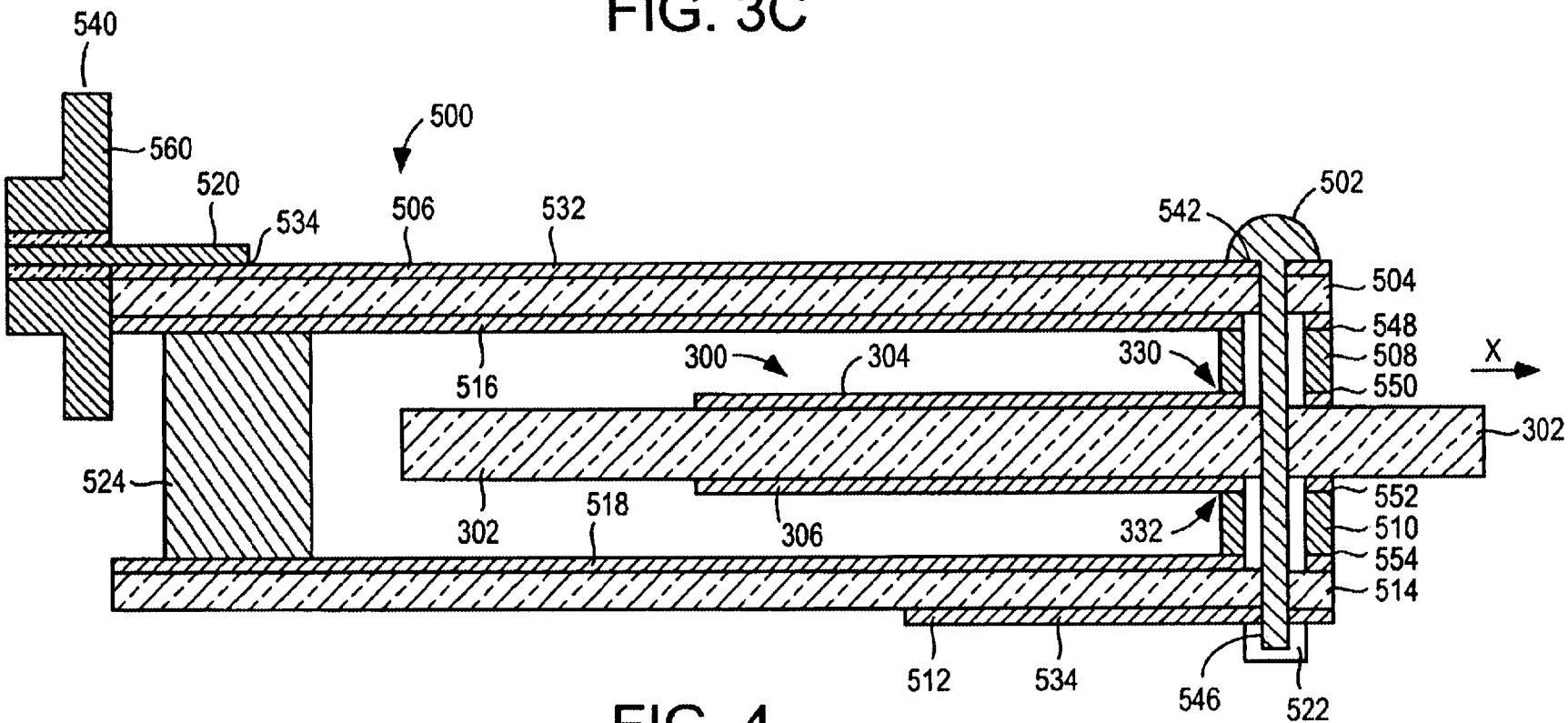
FIG. 4 is a cross sectional view of an exemplary printed wiring embodiment of the antenna which includes a balun.

FIG. 4 illustrates an exemplary compensated balun 500 and transmission line 122 providing balanced mode excitation to terminals of a dual-band driven antenna element and to a second dipole driven antenna element. Compensated baluns are discussed in G. Oltman, "The Compensated Balun," IEEE Transactions on Microwave Theory and Techniques, vol. MTT-14, no. 3, March 1966, pp. 112–119, the disclosure of which is incorporated herein by reference in its entirety. The balun 500 comprises a shorting post 524, a microstrip input line 506, coaxial conductors 502, 508, and 510, and a microstrip compensating stub 512. The microstrip input line 506 includes metal traces 532 and 516 printed on opposite sides of a dielectric sheet 504.

Various connectors can be used to provide electrical connection between a coaxial power source and a microstrip-based balun. In the exemplary embodiment shown in FIG. 5, a coaxial to microstrip connector 540 includes a pin 520 that connects the center conductor of a coaxial cable (not shown) to a first end 534 of the printed metal trace 532 to provide electrical power to the driven antenna elements. A connector shell 560 connects the outer (ground) conductor of a coaxial cable to the printed ground trace 516 of the microstrip input line 506. Suitable coaxial to microstrip connectors 540 are available commercially from Applied Engineering Products, 104 J. W. Murphy Drive, New Haven, Conn. 06513 USA.

The length of the balun of FIG. 5 is approximately 3½ inches, in an embodiment intended for use in a L-band/UHF band omnidirectional/directional antenna. Note that FIG. 5 is not to scale.

The ground 518 of the microstrip compensating stub 512 is a printed metal trace on the dielectric substrate 514. The relatively widely separated grounds 516 and 518 form a high impedance balanced transmission line that is approximately one-quarter wavelength at the balun's center operating frequency. A shorting post 524, formed of copper or another conductive material, electrically connects the grounds 516 and 518, and thus shorts the balanced transmission line formed by the grounds 516 and 518. This short-circuited quarter-wavelength, balanced transmission line presents a high impedance at the open circuited end, which is connected to the antenna terminals 330 and 332 by the conductive tubes 508 and 510. This high impedance condition minimizes balanced mode currents on this transmission line near the antenna terminals, and thus forces balanced mode currents to flow in the driven dipole elements 108 and 136 and the crisscross transmission line 122 formed by traces 304 and 306. The shorting post 524 is formed of an electrically conductive material, and, in an exemplary embodiment, is a copper tube.

The second end of the metal trace 532 of the microstrip input line 506 is electrically connected to an end 542 of a conductive screw 502 or other suitable conductive element. Another end 546 of the screw 502 is electrically connected to a compensating stub 512. The screw 502 can be held in place with a nut 522. The microstrip ground 516 of the microstrip input line 506 is connected to one side 548 of a conductive tube 508. The other side 550 of the conductive tube 508 is connected to the terminal 330 of the conductor 304 that forms part of the balanced transmission line 122. The microstrip ground 518 is connected to one side 554 of a second conductive tube 510 The other side 552 of the second conductive tube 510 is connected to the terminal 332 of the conductor 306 that forms another part of the balanced transmission line 122. Thus, the conductors 304 and 306 form a crisscross balanced transmission line 122 that connects antenna elements 108 and 136 (not shown).

The conductive tubes 508 and 510, formed of copper or another conductive material, surround the conductive screw 502 and are separated from the conductive screw 502 by air or another non-conductive material. The conductive screw 502 is also separated from the microstrip grounds 516 and 518 by air or another non-conductive material. The combination of the copper tubes 508 and 5510 and the conductive screw 502 form two coaxial transmission lines that connect the microstrip input line 506 and the microstrip compensating stub 512 to the terminals of the dual-band driven antenna element and to the balanced transmission line.

In an exemplary embodiment, the grounds 516 and 518 have a width that is greater than the width of the microstrip lines 506 and 512. For example, the width of the grounds 516, 518 can be approximately three times the width of the microstrip lines 506, 512.

In the exemplary embodiment of FIG. 5, the printed wire metallization is one-ounce electro deposited copper. The dielectric sheet of the microstrip input line is 0.030 inches thick and has a dielectric constant of 3.0. The dielectric sheet of the microstrip compensating line is 0.010 inches thick and has a dielectric constant of 10.2. The separation between the microstrip grounds 516 and 518, that form the balun's high impedance, balanced transmission line is 0.3 inches. The copper tubing used for the shorting post 524 and the conductive tubes 508, 510 has an outer diameter of 0.25 inches and an inner diameter of 0.19 inches. The screw 502 can be, for example, a standard number 2 machine screw.

A Yagi-Uda antenna array constructed as the exemplary embodiment shown in FIG. 1, with a transmission line 122 and balun 500 illustrated in FIGS. 3A–3C and FIG. 4 provided favorable results, radiating in the L and UHF bands in response to excitation. Frequency selective impedance matching techniques for the dual-band driven element 108 were incorporated by including resistors 118, located in the frequency selective areas 112 of the dual-band driven element 108. The resistors 118 moderately reduced the UHF radiation efficiency and partially matched the UHF input impedance, while not affecting the L-band performance. An impedance matching circuit, incorporated within the balun/transmission line that fed the antenna provided further impedance matching at both the UHF and L-band frequencies. A resistance of 5 ohms was inserted into each half of the driven dipole at areas 112 (parallel combination of two 10-ohm resistors at each location). A series LC impedance matching circuit was inserted in series with the microstrip input line near the input connector and comprised a half-inch length of 100-ohm microstrip transmission line (the series inductance) and a 5.6 picofarad chip capacitor. The antenna elements were printed on a dielectric sheet measuring less than 6 inches by 7 inches.

The measured performance of this antenna indicates full efficiency, moderate gain, good front-to-back ratio, and better than 2:1 voltage standing wave ratio (VSWR) over a 35% L-band frequency range. The present invention also achieves near-omnidirectional radiation pattern performance and better than 2:1 VSWR over a 6% UHF frequency range; this VSWR performance is achieved by intentionally adding approximately 2 dB of dissipative loss at the UHF frequencies only in the frequency selective areas 112.

Figure 5B:
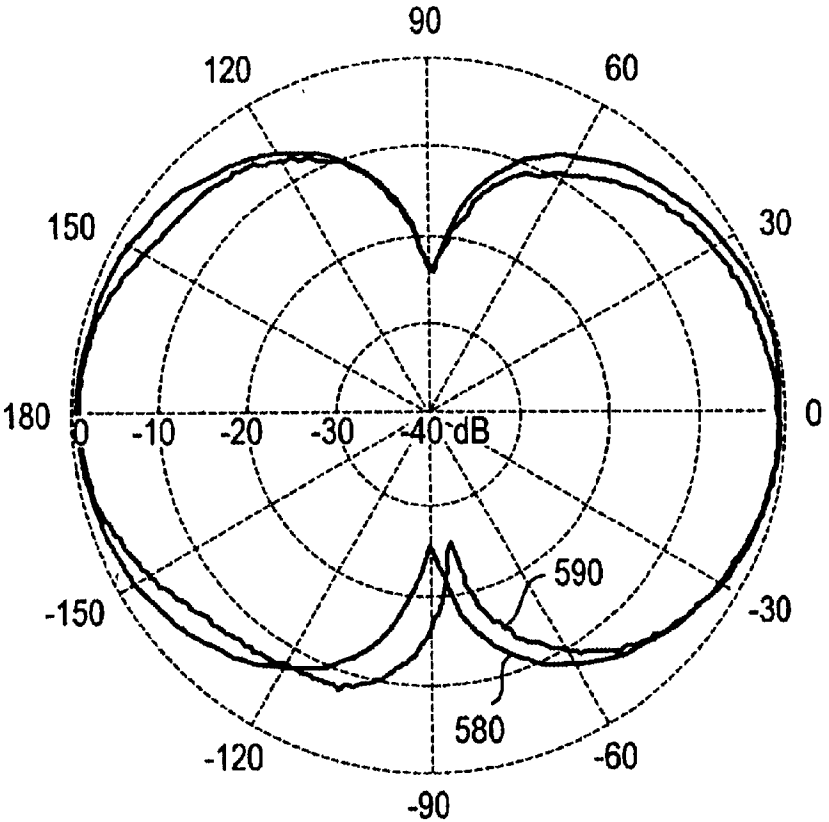
FIGS. 5A and 5B illustrate the computed and measured radiation patterns of an exemplary embodiment of an antenna at a UHF frequency.
Figure 5A:
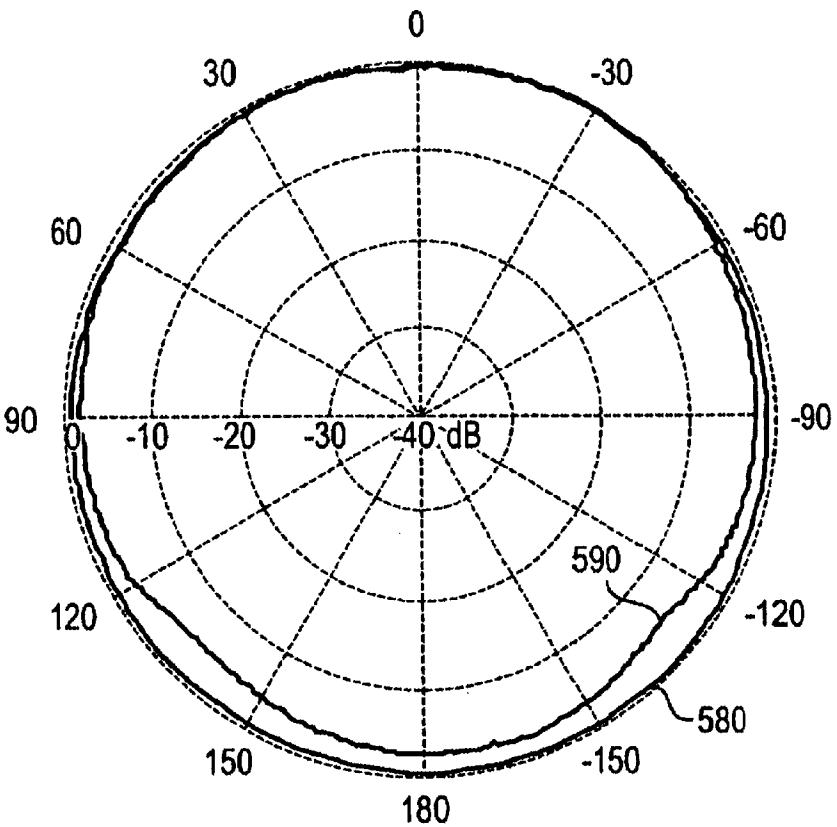
Figure 6B:
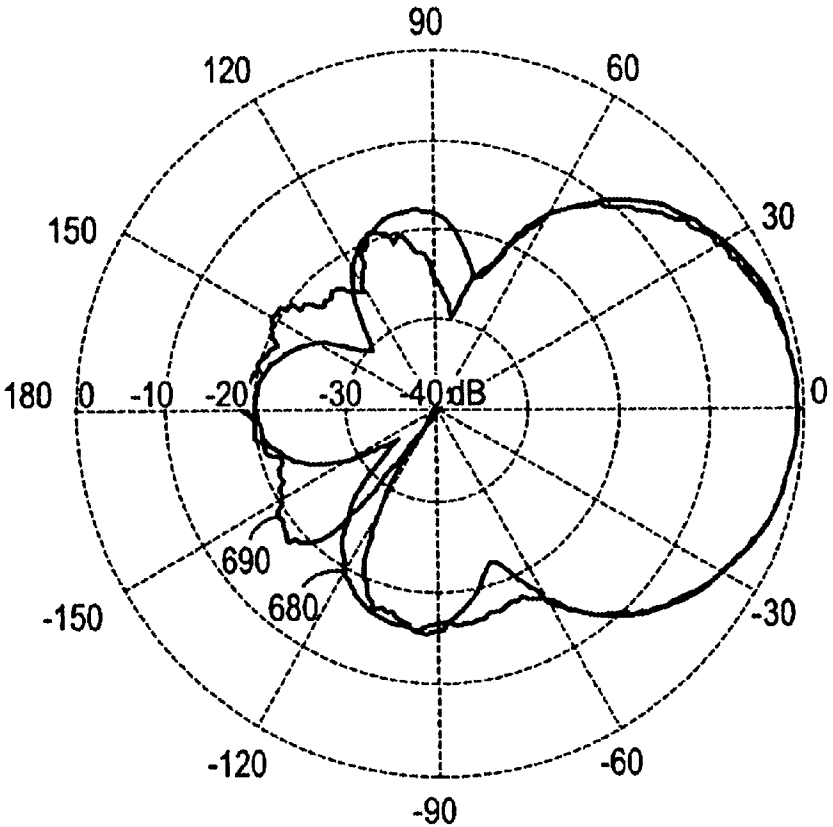
FIGS. 6A and 6B illustrate the computed and measured radiation patterns of an exemplary embodiment of an antenna at an L-band frequency.
Figure 6A:
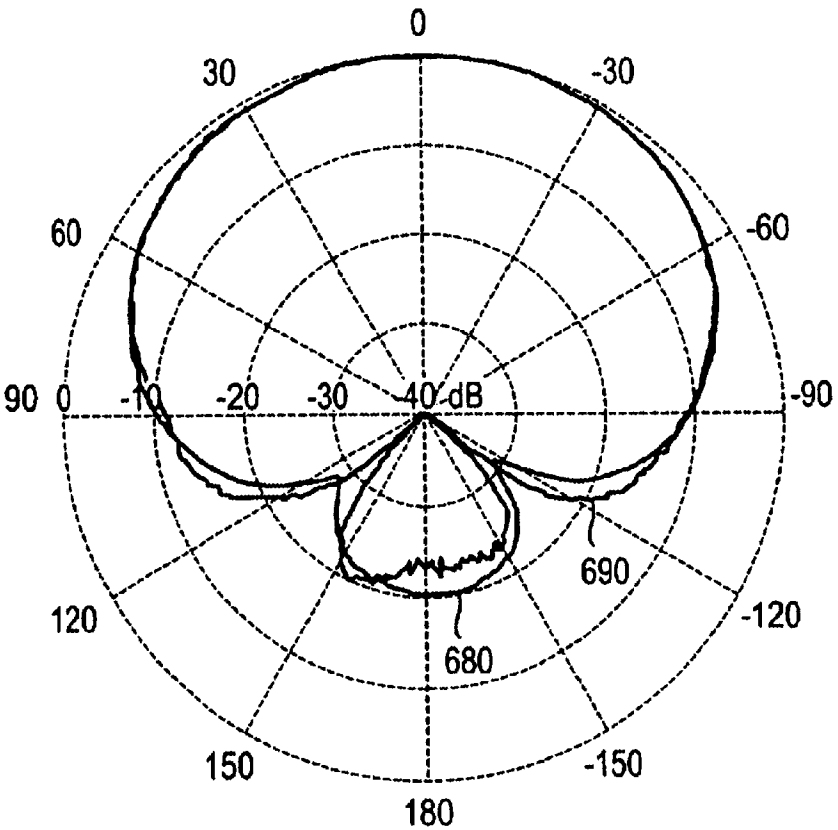

FIGS. 5A and 5B illustrate the computed 580 and measured 590 radiation patterns at a 450 MHz UHF frequency for this dual-band directional/omnidirectional dipole-based antenna for an azimuth cut (H-plane) and an elevation cut (E-plane), respectively. FIGS. 6A and 6B illustrate the computed 680 and measured 690 radiation patterns at an L-band frequency of 1140 MHz. The 0-degree direction in the azimuth cuts in FIGS. 5 and 6 correspond to the forward direction X of the antenna arrays. As seen in FIGS. 5A and 5B, the lower UHF band radiation pattern is omnidirectional in the azimuthal direction, and dual lobed in the elevation direction, as would be expected of a conventional dipole antenna. However, the upper L-band radiation pattern illustrates significant directionality in both azimuth and elevation. The radiation patterns measured at 980, 1020, 1280, and 1380 MHz are similar to the radiation patterns shown for 1140 MHz, except for lower front-to-back ratios (approximately 15 dB for 1020 and 1280 MHz and approximately 10 dB for 980 and 1380 MHz). In addition, the beamwidths decrease and the antenna gains increase as the frequency increases, as in other Yagi-Uda antennas. There is a slight amount of distortion between the computed and measured radiation pattern in each of the illustrated azimuth cuts 5A and 6A, believed to be caused by the presence of a co-polarized feed cable (the cable was cross-polarized for the elevation cuts).

As will be clear to those skilled in the art, the antenna embodiments described above can also simultaneously receive radiation at different frequencies.

The exemplary dual-band driven antenna element 108 can be used in various other antenna configurations. For example, driven elements 108 and 136 can be effectively used in a modified Yagi-Uda configuration with only the directors 132 and no reflector. Alternatively, the driven elements 108 and 136 can be effectively used with only a reflector 134, with no directors. Or, the driven elements 108 and 136 can be effectively used with no reflector and with no directors. These embodiments will produce lower gain, but will be more compact.

The dual-band driven antenna element 108 can also be used without a second driven element 136 in a Yagi-Uda antenna array, with a director and reflector. The dual-band driven antenna element 108 can also be used in a modified Yagi-Uda configuration, for example with only a reflector 134 and no directors. These embodiments will produce lower gain and less bandwidth in the upper frequency, but still exhibit dual-band directional/omnidirectional operation.

The present invention has been described with reference to preferred embodiments. However, it will be readily apparent to those skilled in the art that it is possible to embody the invention in specific forms other than that described above, and that this may be done without departing from the spirit of the invention. The preferred embodiment above is merely illustrative and should not be considered restrictive in any way. The scope of the invention is given by the appended claims, rather than the preceding description, and all variations and equivalents that fall within the range of the claims are intended to be embraced therein.

What is claimed is:

1. A antenna system comprising:

a dual-band driven antenna element for operation at an upper frequency and a lower frequency; and a second antenna element parasitically coupled with the dual-band driven antenna to cooperate at the upper frequency, wherein, in response to an applied electrical current having an upper and a lower frequency, the antenna system radiates in a directional pattern at the upper frequency and in an omnidirectional pattern at the lower frequency.

2. The antenna system as in claim 1, wherein the dual-band driven element is a dipole or monopole antenna.

3. The antenna system of claim 2, wherein the dual-band driven antenna element is a dipole antenna.

4. A antenna system comprising:

a dual-band driven antenna element for operation at an upper frequency and a lower frequency; and a second antenna element, wherein, in response to an applied electrical current having an upper and a lower frequency, the antenna system radiates in a directional pattern at the upper frequency and in an omnidirectional pattern at the lower frequency, wherein the dual-band driven antenna element comprises:

a center dipole that radiates at the upper frequency in response to an applied current at an upper frequency; and at least one choke electrically connected to the center dipole, wherein the center dipole and the choke radiate at a lower frequency in response to an applied current at a lower frequency.

5. The antenna system of claim 4, wherein the choke shortens an electrical length of the dual-band driven antenna element at an upper frequency, the shortened electrical length allowing the simultaneous operation of the dual-band driven antenna element at a lower frequency and at an upper frequency.

6. The antenna system of claim 3, wherein the dipole dual-band driven antenna element comprises:

a center dipole;

a first choke electrically connected to a first end of the center dipole; and a second choke electrically connected to a second end of the center dipole;

the first and second chokes shortening an electrical length of the dual-band driven antenna element at an upper frequency, wherein the center dipole radiates at the upper frequency in response to an applied current at the upper frequency, and wherein the center dipole and the chokes radiate at a tower frequency in response to an applied current at the lower frequency.

7. The antenna system of claim 3, wherein the dipole dual-band driven antenna element comprises:

a center dipole;

two chokes electrically connected to a first end of the center dipole; and two chokes electrically connected to a second end of the center dipole;

wherein the two chokes electrically connected to the first end of the center dipole and the two chokes electrically connected to the second end of the center dipole shorten an electrical length of the dual-band driven antenna element at an upper frequency, and wherein the center dipole radiates at the upper frequency in response to an applied current at the upper frequency, and wherein the center dipole and the chokes radiate at a lower frequency in response to an applied current at the lower frequency.

8. The antenna system of claim 5, wherein the dual-band driven antenna element further comprises:

a frequency selective impedance matching circuit connected in series between the center dipole and the choke, the frequency selective impedance matching circuit being adapted to match the impedance of a transmission line.

9. The antenna system of claim 8, wherein the impedance matching circuit comprises a resistor.

10. The antenna system as in claim 8, wherein the impedance matching circuit comprises a reactance element.

11. The antenna system of claim 1, wherein the second antenna element is a reflector which reflects radiation at the upper frequency.

12. The antenna system of claim 11, wherein the reflector is printed wiring having a length of about one half of a wavelength of radiation at the upper frequency.

13. The antenna system of claim 11, wherein the reflector has a width which is greater than a width of the dual-band driven antenna element.

14. A antenna system comprising:

a dual-band driven antenna element for operation at an upper frequency and a lower frequency; and a second antenna element, wherein, in response to an applied electrical current having an upper and a lower frequency, the antenna system radiates in a directional pattern at the upper frequency and in an omnidirectional pattern at the lower frequency, wherein the second antenna element comprises at least one director, configured to direct radiation at the upper frequency.

15. The antenna system of claim 14, wherein the at least one director is printed wiring.

16. The antenna system of claim 1, wherein the second antenna element includes a second driven element electrically coupled to the dual-band driven antenna element, and is operational at the upper frequency.

17. The antenna system as in claim 16, further comprising:

a transmission line, wherein the second driven element and the dual-band driven antenna element are electrically coupled by the transmission line.

18. The antenna system as in claim 17, wherein the transmission line is a balanced transmission line adapted to provide electrical power to the dual-band driven antenna element and the second driven element.

19. The antenna system of claim 17, wherein the transmission line comprises:

a first part printed on a first side of a dielectric sheet;

and a second part printed on a second side of the dielectric sheet.

20. The antenna system of claim 19, wherein the first transmission line part comprises a first electrically conductive trace and a second electrically conductive trace printed on the first side of the dielectric sheet, the first and second traces being substantially parallel and being connected at their ends, the first and second traces being separated in a region between their ends by a material with a dielectric constant of about 1, and wherein the second transmission line part comprises a third electrically conductive trace and a fourth electrically conductive trace printed on the second side of the dielectric sheet, the third and fourth traces being parallel and being connected at their ends, the third and fourth traces being separated in a region between their ends by a material with a dielectric constant of about 1.

21. The antenna system of claim 20, further comprising an opening formed through the dielectric sheet between at least two of the electrically conductive traces.

22. The antenna system of claim 20, further comprising:

a second opening formed through the dielectric sheet in an area outside the transmission line; and a third opening formed through the dielectric sheet in a second area outside the transmission line opposite the first area.

23. The antenna system of claim 17, wherein the dual-band driven element and the second driven antenna elements are dipoles, and further comprising:

a balun configured to receive unbalanced electrical power and to provide balanced electrical power to the dual-band driven element and the second driven antenna element.

24. The antenna system of claim 23, wherein the balun is a compensated balun and is electrically coupled to the dual-band driven element and to the transmission line.

25. The antenna system of claim 24, wherein a longitudinal axis of the balun is arranged substantially perpendicular to a principal axis of the dipole dual-band driven element and to the principal axis of the dipole second driven element, and wherein the longitudinal axis of the balun is substantially parallel to the transmission line.

26. The antenna system of claim 16, further comprising:

a reflector configured to reflect radiation at the upper frequency, the antenna system forming a Yagi-Uda antenna array.

27. The antenna system of claim 16, further comprising:

at least one director configured to direct radiation at the upper frequency, the dual-band driven antenna element, the second driven element, and the at least one director element arranged to form a Yagi-Uda antenna array.

28. The antenna system of claim 27, further comprising:

a reflector configured to reflect radiation at the upper frequency.

29. The antenna system of claim 16, wherein the dual-band driven element comprises:

a center dipole;

two chokes electrically connected to a first end of the center dipole; and two chokes electrically connected to a second end of the center dipole;

wherein the two chokes electrically connected to the first end of the center dipole and the two chokes electrically connected to the second end of the center dipole shorten an electrical length of the dual-band antenna element at the upper frequency, and wherein the center dipole radiates at the upper frequency in response to an applied current at the upper frequency, and wherein the center dipole and the chokes radiate at the lower frequency in response to an applied current at the lower frequency.

30. The antenna system of claim 29, wherein each choke comprises:

a u-shaped extension with an end of the extension connected to an end of the center dipole, the u-shaped extension having two legs which form a quarter-wavelength transmission line at the upper frequency, and wherein a segment of the u-shaped extension forms a short circuit to current at the upper frequency.

31. The antenna system of claim 30, wherein the dual-band driven element further comprises:

a conductive extension electrically coupled to the short circuit segment of at least one u-shaped extension, the conductive extension adapted to maintain radiation efficiency at the upper frequency and to improve radiation efficiency and input impedance bandwidth at the lower frequency.

32. The dual-band antenna system of claim 31, wherein the dual-band driven antenna element has an electrical length which is short relative to one half of a wavelength at the lower frequency, and wherein the dual-band driven element comprises:

impedance devices electrically connected to the u-shaped extension at the short circuit segment of the u-shaped extension, wherein the impedance devices enable the center dipole and the u-shaped extensions to radiate at a frequency at the lower frequency in response to an applied current with the lower frequency.

33. A antenna system comprising:

a dipole dual-band driven antenna element having a center dipole that radiates at an upper frequency in response to an applied current at the upper frequency and at least one choke electrically connected to the center dipole, wherein the center dipole and the choke radiate at a lower frequency in response to an applied current at the lower frequency;

second dipole driven element operational at the upper frequency and electrically coupled to the dual-band driven antenna element; and a transmission line and a balun electrically coupled to the second dipole driven element and the dipole dual-band driven antenna element, wherein, in response to an applied electrical current having an upper and a lower frequency, the antenna system radiates in a directional pattern at the upper frequency and in an omnidirectional pattern at the lower frequency.

* * * * *

UNITED STATES PATENT AND TRADEMARK OFFICE

CERTIFICATE OF CORRECTION

PATENT NO. : 6,839,038 B2
DATED : January 4, 2005
INVENTOR(S) : Michael E. Weinstein It is certified that error appears in the above-identified patent and that said Letters Patent is hereby corrected as shown below:

Column 14,
Line 4, “a tower frequency” should read -- a lower frequency --; and

Column 15,
Line 35, “second driven antenna elements” should read -- second driven antenna element --.

Signed and Sealed this

Sixth Day of September, 2005

JON W. DUDAS
*Director of the United States Patent and Trademark Office*